US008446097B2

(12) United States Patent
Takemori et al.

(10) Patent No.: US 8,446,097 B2
(45) Date of Patent: May 21, 2013

(54) DISCHARGE LAMP IGNITION APPARATUS AND DISCHARGE LAMP IGNITION METHOD

(75) Inventors: Takahiro Takemori, Osaka (JP); Kensuke Nagauchi, Osaka (JP)

(73) Assignee: Panasonic Corporation, Kadoma-shi (JP)

( * ) Notice: Subject to any disclaimer, the term of this patent is extended or adjusted under 35 U.S.C. 154(b) by 205 days.

(21) Appl. No.: 13/170,191

(22) Filed: Jun. 28, 2011

(65) Prior Publication Data

US 2011/0316436 A1 Dec. 29, 2011

(30) Foreign Application Priority Data

Jun. 28, 2010 (JP) ..... 2010-145853

(51) Int. Cl.
*H05B 37/02* (2006.01)

(52) U.S. Cl.
USPC ..... 315/224; 315/307; 315/308

(58) Field of Classification Search
USPC ..... 315/DIG. 7, 41, 44, 59, 61, 94, 105, 315/200 R, 209 R, 224, 246, 248, 258, 279, 315/291, 326, 349, 307, 308
See application file for complete search history.

(56) References Cited

U.S. PATENT DOCUMENTS 6,160,362 A * 12/2000 Shone et al. ..... 315/308
8,018,181 B2 * 9/2011 Roman ..... 315/307

FOREIGN PATENT DOCUMENTS

JP 2009-217953 A 9/2009

* cited by examiner

*Primary Examiner* — Jimmy T Vu
*Assistant Examiner* — Henry Luong
(74) *Attorney, Agent, or Firm* — Judge Patent Associates

(57) ABSTRACT

In a discharge lamp ignition apparatus, a control circuit unit: lowers a drive frequency from a predetermined initial frequency; establishing, if a resonant voltage reaches an ignition voltage for igniting a discharge lamp, a drive frequency at the ignition voltage as a discharge-lamp-ignition drive frequency which is a frequency for igniting the discharge lamp; and sets, if the resonant voltage does not reach the ignition voltage even though the drive frequency is lowered from the predetermined initial frequency to a resonant frequency, a frequency which is a predetermined value higher than the drive frequency at a resonant voltage peak voltage as the discharge-lamp-ignition drive frequency, and an inverter circuit unit alternating-current drives the resonant circuit unit at the discharge-lamp-ignition drive frequency established by the control circuit unit.

5 Claims, 7 Drawing Sheets

DISCHARGE LAMP IGNITION APPARATUS 100

DISCHARGE LAMP IGNITION APPARATUS AND DISCHARGE LAMP IGNITION METHOD

BACKGROUND OF THE INVENTION

1. Field of the Invention

The present invention relates to discharge lamp ignition apparatuses and discharge lamp ignition methods for igniting discharge lamps, and more particularly relates to discharge lamp ignition apparatuses and discharge lamp ignition methods using LC resonance.

2. Description of the Background Art

In projection type image display units (for example, projectors), discharge lamps such as high pressure mercury vapor lamps or the like are used for projecting images. Discharge lamp ignition apparatuses for igniting the discharge lamps are required to ignite the discharge lamps stably.

In general, discharge lamp ignition apparatuses have functions of: generating a high voltage which starts an electric discharge between electrodes and is applied until the electric discharge shifts to a stable operation state; and supplying a discharge lamp with a stable power as desired at a low voltage after the electric discharge between the electrodes shifts to the stable operation state.

In general, high voltage generation circuits which realize the function of generating a high voltage have a serial LC resonant circuit and apply, to electrodes of a discharge lamp, a resonant voltage obtained by a resonance phenomenon in the serial LC resonant circuit. Accordingly, the discharge lamp is ignited.

In this case, because of individual differences in values of an inductor (L) and values of a capacitor (C) in the serial LC resonant circuit, it is necessary to specify and control a resonant frequency for each serial LC resonant circuit.

For example, Japanese Laid-Open Patent Publication No. 2009-217953 discloses a discharge lamp ignition apparatus for repeatedly raising and lowering, in a range that includes a resonant frequency in a serial LC resonant circuit, a frequency of an alternating-current ramp voltage which causes an electric discharge in a discharge lamp. By applying a resonant voltage generated accordingly to the discharge lamp, the discharge lamp ignition apparatus ignites the discharge lamp stably.

However, in the above-described serial LC resonant circuit, there are not only individual difference in values of an L and values of a C but also individual differences caused by such as loss due to heat generated in coil, loss due to winding, winding capacity depending on a way of winding, temperature characteristics, and the like. Furthermore, there are individual differences caused by operations of circuits such as an inverter circuit unit which drives the serial LC resonant circuit, a power supply circuit unit which supplies a power supply voltage to the inverter circuit unit, and the like. Consequently, in conventional discharge lamp ignition apparatuses, a value of a resonant voltage generated by the serial LC resonant circuit also changes greatly.

As a result, at the resonant frequency in the serial LC resonant circuit, a high voltage for stably igniting the discharge lamp may not be obtained successfully, resulting in a possibility of ignition failure of the discharge lamp.

On the contrary, there is also a case where a peak value of the resonant voltage at the resonant frequency is raised greatly, and, at the time of driving at the resonant frequency, an unexpected excessive current flows in or an unexpected excessive voltage is applied to the discharge lamp and circuit elements that constitute the discharge lamp ignition apparatus, resulting in a possibility of breakage of the discharge lamp and the circuit elements.

SUMMARY OF THE INVENTION

Therefore, the present invention has been achieved in view of the above problem, and its object is to provide a discharge lamp ignition apparatus and a discharge lamp ignition method for, when igniting a discharge lamp, by controlling a high voltage applied to the discharge lamp, igniting the discharge lamp stably and suppressing an unexpected excessive current/voltage from flowing in/being applied to the discharge lamp and circuit elements that constitute the discharge lamp ignition apparatus.

In order to achieve the above object, a discharge lamp ignition apparatus of the present invention is a discharge lamp ignition apparatus for igniting a discharge lamp including: a direct-current power supply generation circuit unit for supplying a direct-current power supply voltage; a resonant circuit unit constituted from an inductor and a capacitor, for applying a resonant voltage generated by the inductor and the capacitor to the discharge lamp; a voltage detection circuit unit for detecting the resonant voltage being applied to the discharge lamp; an inverter circuit unit for, based on the direct-current power supply voltage supplied by the direct-current power supply generation circuit unit, alternating-current driving the resonant circuit unit at a drive frequency; and a control circuit unit for monitoring the resonant voltage detected by the voltage detection circuit unit and controlling the inverter circuit unit based on the resonant voltage, and the control circuit unit lowers the drive frequency from a predetermined initial frequency and when the resonant voltage reaches an ignition voltage at which the discharge lamp ignites, establishes the drive frequency for the ignition voltage as a discharge-lamp-ignition drive frequency, being the frequency for igniting the discharge lamp, and if the resonant voltage does not reach the ignition voltage even though the drive frequency is lowered from the predetermined initial frequency to the resonant frequency, establishes as the discharge-lamp-ignition drive frequency a frequency that is a predetermined value higher than the drive frequency at the resonant voltage peak voltage, and the inverter circuit unit alternating-current drives the resonant circuit unit at the discharge-lamp-ignition drive frequency established by the control circuit unit.

Preferably, the control circuit unit may control the inverter circuit unit at the discharge-lamp-ignition drive frequency.

Still preferably, the control circuit unit may establish the discharge-lamp-ignition drive frequency continuously for a predetermined time period.

Yet preferably, the control circuit unit may periodically establishes the discharge-lamp-ignition drive frequency.

In order to achieve the above object, the discharge lamp ignition method of the present invention is a discharge lamp ignition method performed by a discharge lamp ignition apparatus for igniting a discharge lamp, the method including the steps of: setting a drive frequency at which an inverter circuit is driven to a predetermined initial frequency; lowering the drive frequency gradually from the initial frequency at predetermined intervals; detecting whether a resonant voltage in a resonant circuit constituted from an inductor and a capacitor has reached a preset ignition voltage for igniting the discharge lamp; obtaining, if the resonant voltage does not reach the ignition voltage, a drive frequency at a resonant voltage peak voltage that is lower than the ignition voltage and establishing as a discharge-lamp-ignition drive frequency the drive frequency a predetermined value higher than the resonant frequency; obtaining the drive frequency at the ignition voltage if the resonant voltage reaches the ignition voltage; setting the drive frequency as the discharge-lamp-ignition drive frequency; and performing a control operation so as to drive the inverter circuit at the discharge-lamp-ignition drive frequency.

Further, in order to achieve the above object, processes performed by respective components of the discharge lamp ignition apparatus of the present invention can be regarded as a discharge lamp ignition method that provides a series of procedures. The method is provided in the form of a program for causing a computer to execute the series of procedures. The program may be recorded in a computer-readable recording medium to be introduced to the computer.

As described above, according to the discharge lamp ignition apparatus and the discharge lamp ignition method of the present invention, when igniting a discharge lamp, by controlling a high voltage applied to the discharge lamp, the discharge lamp can be ignited without fail and unexpected excessive current/voltage can be suppressed from flowing in/being applied to the discharge lamp and the circuit elements that constitute the discharge lamp ignition apparatus.

Consequently, the failure rate of the discharge lamp and the circuit elements that constitute the discharge lamp ignition apparatus can be reduced, thereby increasing trust of users.

The present invention is useful, for example, for discharge lamp ignition apparatuses using a high pressure mercury vapor lamp as a discharge lamp, projection type image equipments, and the like.

These and other objects, features, aspects and advantages of the present invention will become more apparent from the following detailed description of the present invention when taken in conjunction with the accompanying drawings.

DESCRIPTION OF THE PREFERRED EMBODIMENTS

In the following, an embodiment of the present invention will be described with reference to drawings.

Figure 1:
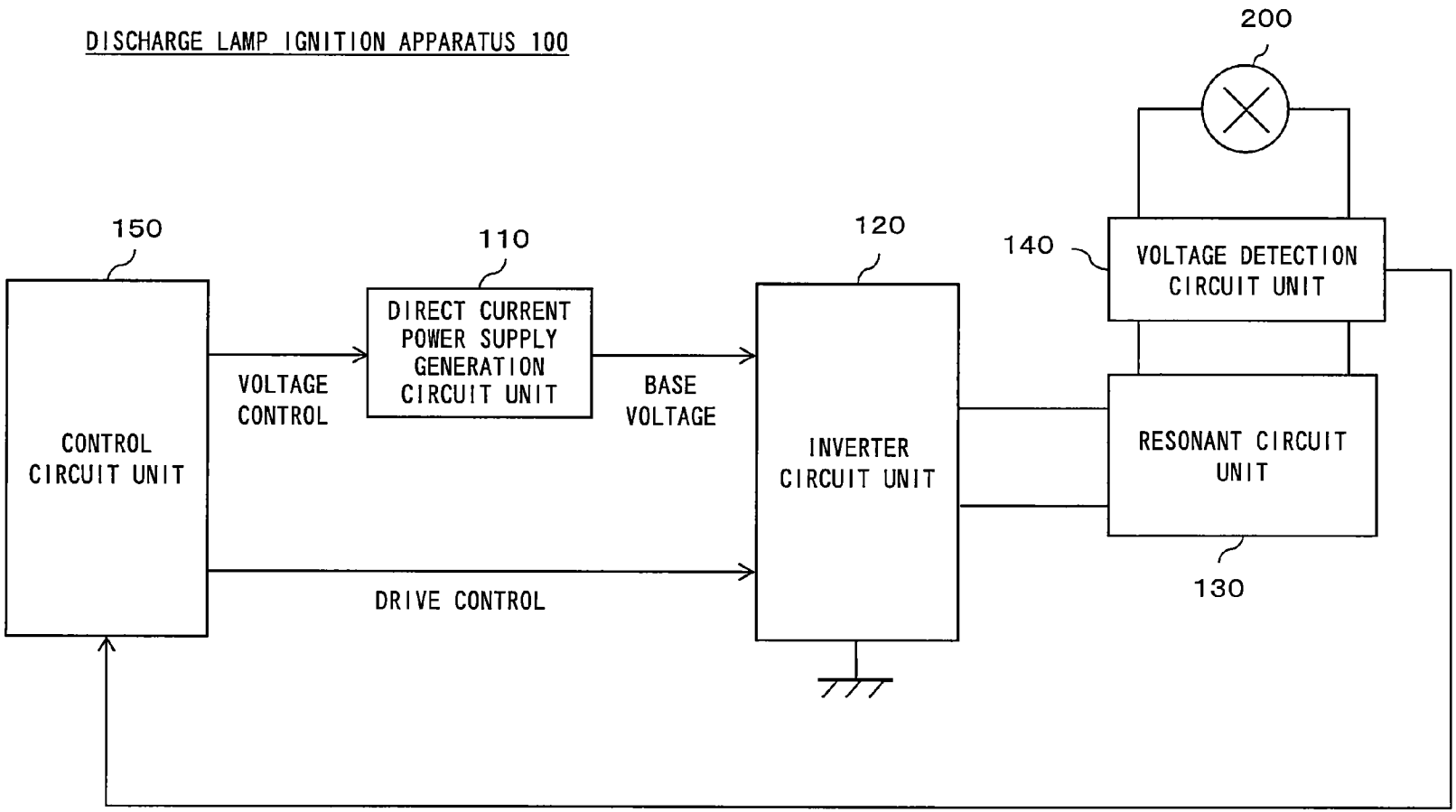
FIG. 1 is a block diagram illustrating a configuration of a discharge lamp ignition apparatus 100 according to an embodiment of the present invention.

FIG. 1 is a block diagram showing a configuration of a discharge lamp ignition apparatus 100 according to an embodiment of the present invention. In FIG. 1, the discharge lamp ignition apparatus 100 includes a direct-current power supply generation circuit unit 110, an inverter circuit unit 120, a resonant circuit unit 130, a voltage detection circuit unit 140, and a control circuit unit 150. By using a DC/AC converter which includes a full bridge type circuit constituted from four switching elements, the discharge lamp ignition apparatus 100 applies an alternating-current voltage to a discharge lamp 200 and ignites the discharge lamp 200.

The direct-current power supply generation circuit unit 110 supplies the inverter circuit unit 120 with a base voltage which is a direct-current power supply voltage.

Based on the direct-current power supply voltage supplied by the direct-current power supply generation circuit unit 110, the inverter circuit unit 120 alternating-current drives the resonant circuit unit 130 at a drive frequency.

The resonant circuit unit 130 is constituted from an inductor and a capacitor and applies a resonant voltage generated by the inductor and the capacitor to the discharge lamp 200. Specifically, the resonant circuit unit 130 includes a serial LC circuit and generates a high voltage so as to cause an electric discharge between electrodes of the discharge lamp 200 at the time of starting to ignite the discharge lamp 200.

The voltage detection circuit unit 140 detects the resonant voltage being applied to the discharge lamp 200. Specifically, the voltage detection circuit unit 140 divides the voltage generated by the resonant circuit unit 130 and detects the divided voltage.

The control circuit unit 150 monitors the resonant voltage detected by the voltage detection circuit unit 140 and controls the inverter circuit unit 120 based on the resonant voltage. Specifically, to the control circuit unit 150, the resonant voltage detected by the voltage detection circuit unit 140 is fedback. Then, the control circuit unit 150 controls the direct-current power supply generation circuit unit 110, thereby controlling the base voltage supplied to the inverter circuit unit 120. Further, the control circuit unit 150 directly controls the drive of the inverter circuit unit 120.

Figure 2:
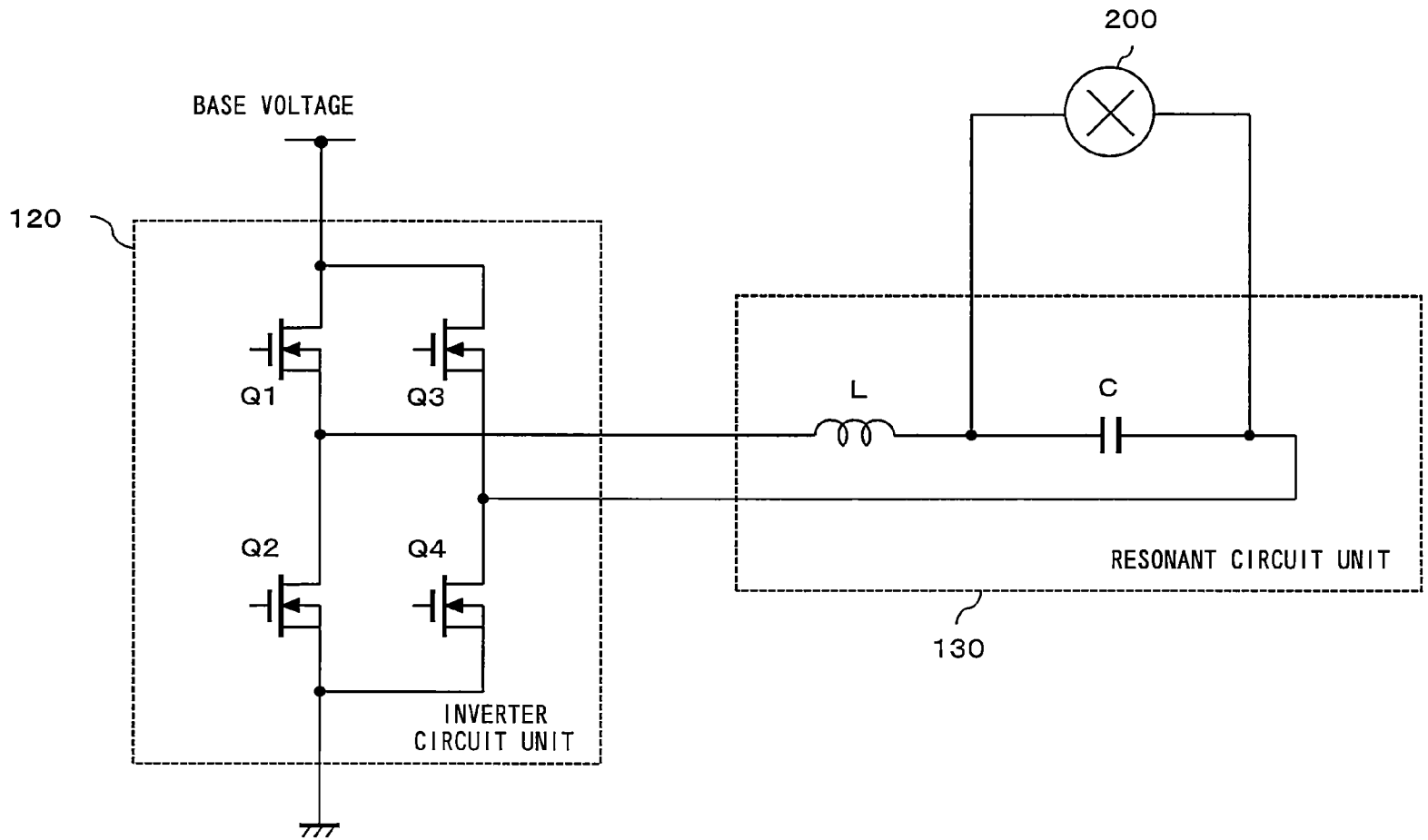
FIG. 2 illustrates internal configurations of an inverter circuit unit 120 and a resonant circuit unit 130 in the discharge lamp ignition apparatus 100 according to the embodiment of the present invention.

FIG. 2 illustrates internal configurations of the inverter circuit unit 120 and the resonant circuit unit 130 in the discharge lamp ignition apparatus 100 according to the embodiment of the present invention. In FIG. 2, the inverter circuit unit 120 includes a full bridge circuit configuration constituted from four switching elements Q1 to Q4, and the resonant circuit unit 130 includes a serial LC resonant circuit configuration.

The inverter circuit unit 120 is supplied with the base voltage which is the direct-current power supply voltage such that a time period in which the switching elements Q1 and Q4 are turned on while the switching elements Q2 and Q3 are turned off and a time period in which the switching elements Q1 and Q4 are turned off while the switching elements Q2 and Q3 are turned on are alternately repeated, thereby generating an alternating-current voltage.

It should be noted that a frequency of the alternating-current voltage thus generated is determined based on the drive frequency of the inverter circuit unit 120.

To the resonant circuit unit 130, the alternating-current voltage determined based on the base voltage and the drive frequency of the inverter circuit unit 120 is applied. Then, when the drive frequency is near the resonant frequency of the serial LC circuit, the resonant voltage (a high voltage) is generated at both ends of the C.

The discharge lamp 200 is connected in parallel with the resonant circuit unit 130 and the resonant voltage (a high voltage) is applied to the discharge lamp 200. Consequently, an insulation breakdown occurs between the electrodes of the discharge lamp 200, thereby igniting the discharge lamp 200.

Figure 3:
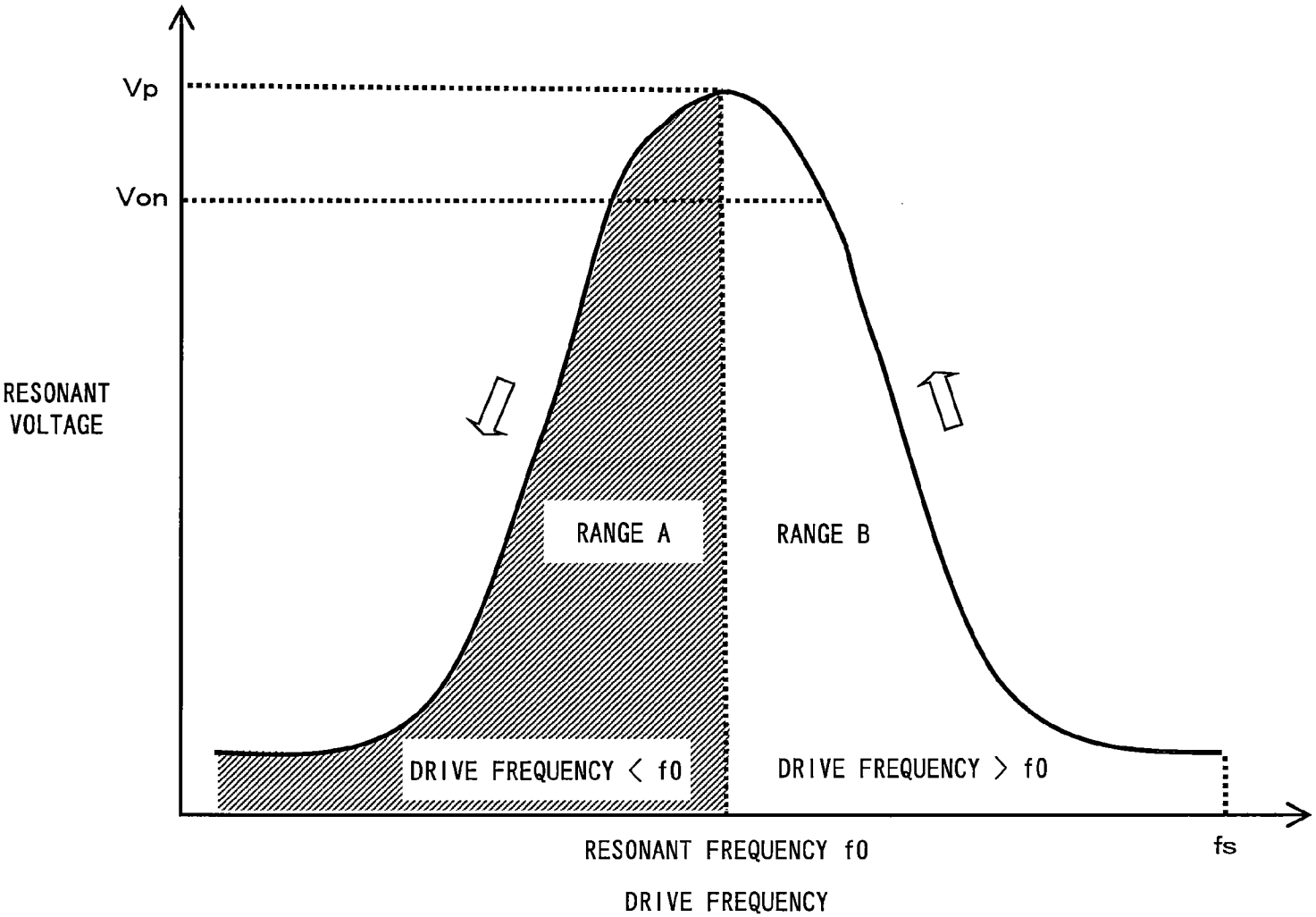
FIG. 3 is a graph illustrating a relationship between a drive frequency of the inverter circuit unit 120 and a resonant voltage generated by the resonant circuit unit 130.

FIG. 3 is a graph illustrating a relationship between the drive frequency of the inverter circuit unit 120 and the resonant voltage generated by the resonant circuit unit 130. In FIG. 3, a frequency range in which the drive frequency is lower than a resonant frequency f0 is referred to as a range A and a frequency range in which the drive frequency is higher than the resonant frequency f0 is referred to as a range B.

The drive frequency of the inverter circuit unit 120 is controlled by the control circuit unit 150. The control circuit unit 150 controls the drive frequency such that the drive frequency is lowered gradually at predetermined intervals from an initial frequency fs which is sufficiently higher than the resonant frequency f0.

In the frequency range B in which the drive frequency of the inverter circuit unit 120 is between the initial frequency fs and the resonant frequency f0, the resonant voltage generated by the resonant circuit unit 130 is raised as the drive frequency of the inverter circuit unit 120 is lowered (as time progresses).

Then, at a point where the drive frequency of the inverter circuit unit 120 becomes the resonant frequency f0, the resonant voltage of the resonant circuit unit 130 becomes a peak voltage Vp.

Further, in the frequency range A in which the drive frequency of the inverter circuit unit 120 is lower than the resonant frequency f0, the resonant voltage of the resonant circuit unit 130 is lowered as the drive frequency is lowered.

Figure 4:
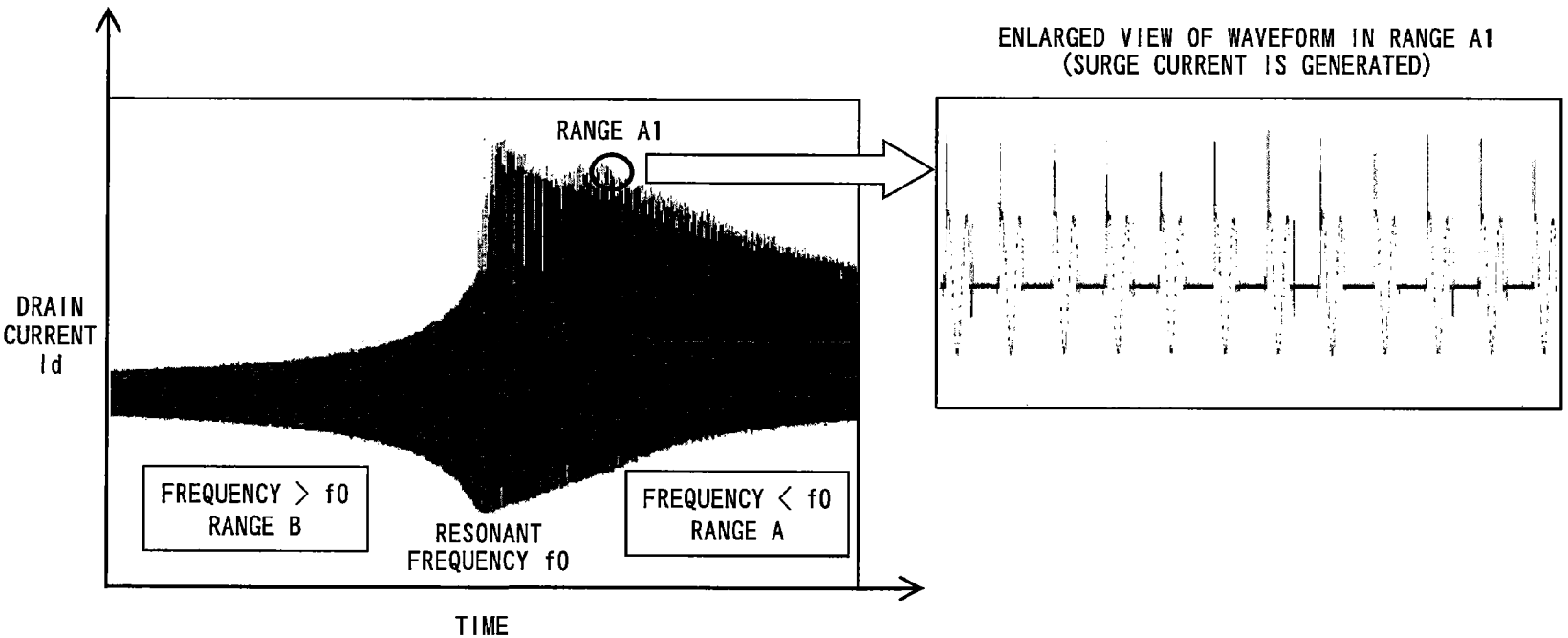
FIG. 4 illustrates a drain current Id which flows in a switching element Q4 when the drive frequency of the inverter circuit unit 120 is lowered gradually from an initial frequency fs.

FIG. 4 illustrates a drain current Id which flows in the switching element Q4 when the drive frequency of the inverter circuit unit 120 is lowered gradually from the initial frequency fs. The drive frequency of the inverter circuit unit 120 is gradually lowered from the initial frequency fs to the resonant frequency f0 (the range A) and further lowered from the resonant frequency f0 to a frequency which is sufficiently lower than the resonant frequency f0 (the range B). As shown in FIG. 4, in the drain current Id which flows in the switching element Q4, a surge current is generated in the range A (an enlarged view of a range A1).

In other words, when the drive frequency of the inverter circuit unit 120 falls within the range A, the surge current which is an unexpected excessive current is generated in the drain current Id.

For the above reason, in a conventional discharge lamp ignition apparatus, individual differences of an inductor (L) and a capacitor (C) in a serial LC resonant circuit are taken into consideration and a drive frequency of an inverter circuit unit is repeatedly raised and lowered. By doing so, a resonant voltage peak voltage Vp at a resonant frequency f0 is detected and a sufficiently high voltage which successfully causes an insulation breakdown between electrodes in a discharge lamp can be obtained. Meanwhile, there is a possibility that, when the peak voltage Vp at the resonant frequency f0 is an excessive voltage, an excessive current/voltage flows in/is applied to switching elements or the like of the inverter circuit unit 120, resulting in breakage of the discharge lamp and circuit elements.

Therefore, in the embodiment of the present invention, as shown in FIG. 3, an ignition voltage Von which ignites the discharge lamp 200 when the drive frequency of the inverter circuit unit 120 is within the range B is established. At this time, the ignition voltage Von is lower than the resonant voltage peak voltage Vp at the resonant frequency f0.

Specifically, the ignition voltage Von is preset as a voltage which causes an insulation breakdown between the electrodes of the discharge lamp 200. Then, the drive frequency of the inverter circuit unit 120 is lowered gradually from the initial frequency fs, and when the ignition voltage Von is detected at the frequency f1 which is higher than the resonant frequency f0, the frequency f1 is established as a discharge-lamp-ignition drive frequency which is a frequency for igniting the discharge lamp 200.

Figure 5:
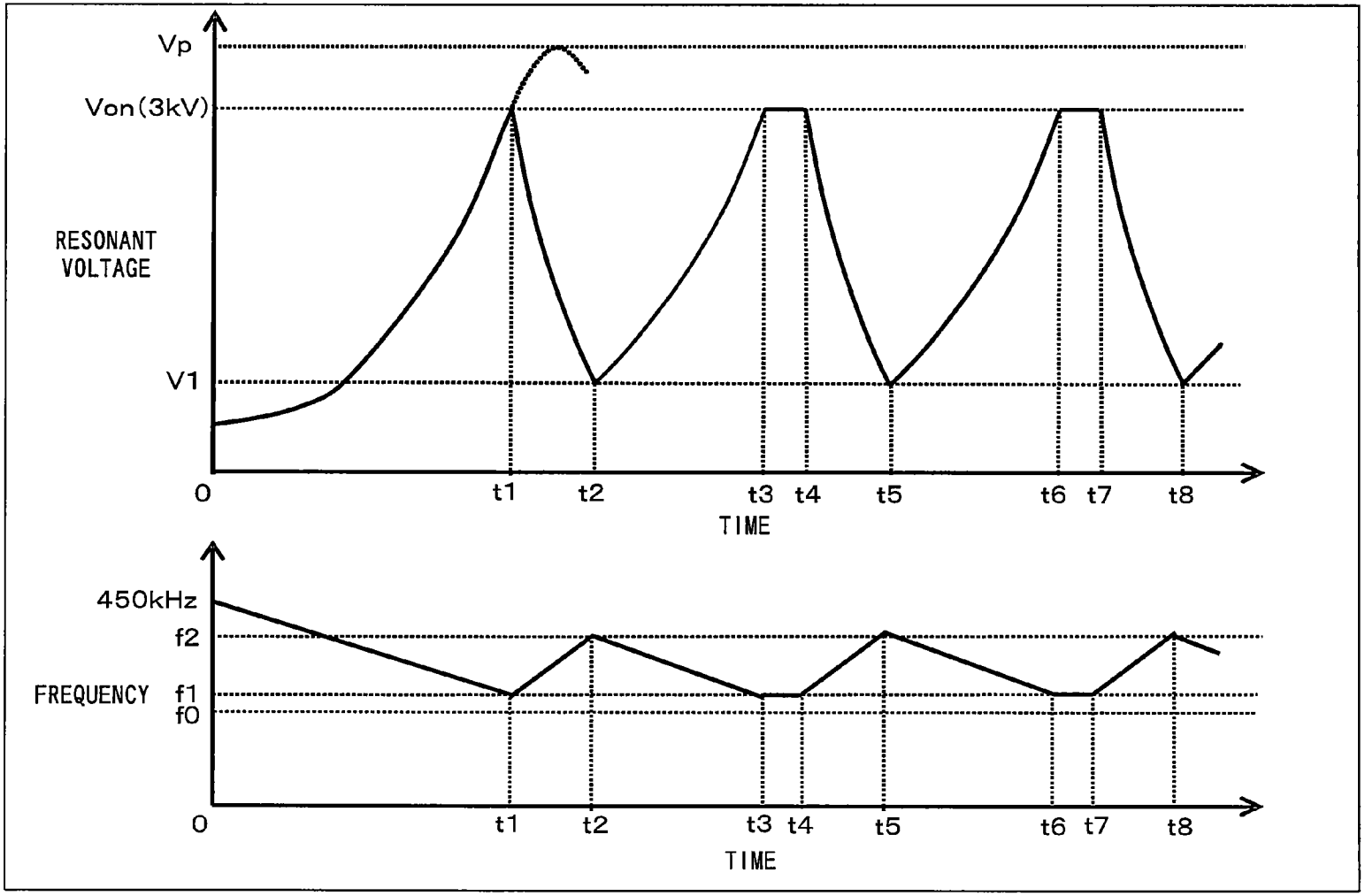
FIG. 5 is a timing chart illustrating the resonant voltage generated by the resonant circuit unit 130 and the drive frequency of the inverter circuit unit 120 in a case where the resonant voltage reaches an ignition voltage Von.

FIG. 5 is a timing chart illustrating the resonant voltage generated by the resonant circuit unit 130 and the drive frequency of the inverter circuit unit 120 in a case where the resonant voltage reaches the ignition voltage Von. Here, as a characteristic of the discharge lamp 200, when the voltage which causes an insulation breakdown between the electrodes of the discharge lamp 200 is greater than or equal to 2.7 kV, the ignition voltage Von is set to 3 kV.

When the resonant frequency f0 which is calculated based on a central value of values of the L (inductor) and the C (capacitor) of the resonant circuit unit 130 is approximately 350 kHz, the resonant voltage of the resonant circuit unit 130 is obtained by a tertiary harmonic wave at the drive frequency of the inverter circuit unit 120. That is, when the drive frequency of the inverter circuit unit 120 becomes ⅓ (≈117 kHz) of the resonant frequency f0 (≈350 kHz), the resonant voltage of the resonant circuit unit 130 becomes the peak voltage Vp.

As described above, normally, the resonant frequency f0 of the resonant circuit unit 130 involves individual differences or the like of the L and the C, and thus the drive frequency of the inverter circuit unit 120 needs to be adjusted individually and at each startup. The initial frequency fs shown in FIG. 3 is set to a frequency (here, 450 kHz) which is sufficiently higher than the resonant frequency f0 (≈350 kHz) of the resonant circuit unit 130, and the drive of the inverter circuit unit 120 is started (the drive frequency is 150 kHz).

Then, when the drive frequency is lowered gradually from the initial frequency fs (=450 kHz) at predetermined intervals, at the frequency f1 (time t1) which is higher than the resonant frequency f0, the voltage detection circuit unit 140 detects that the resonant voltage generated by the resonant circuit unit 130 is the ignition voltage Von (3 kV). Accordingly, the frequency f1 (the drive frequency is (f1)/3) at the resonant voltage (=the ignition voltage Von) is established as the drive frequency (the discharge-lamp-ignition drive frequency) of the inverter circuit unit 120.

During a time period from time t1 to time t2, the drive frequency is raised to a frequency f2, and the resonant voltage is lowered to a voltage V1 which is sufficiently lower than the ignition voltage Von (3 kV).

During a time period from time t2 to time t3, the drive frequency is lowered gradually from the frequency f2 at predetermined intervals again. Then, during a time period from time t3 to time t4, the resonant voltage (=the ignition voltage Von) is continuously applied to the discharge lamp 200.

Then, during a time period from time t4 to time t5, the drive frequency is raised to the frequency f2 again, and the resonant voltage is lowered to the voltage V1 which is sufficiently lower than the ignition voltage Von (3 kV).

Subsequently, operations from time t2 to time t5 are repeated until the discharge lamp 200 is ignited.

As described above, while the high voltage of the ignition voltage Von (3 kV) is continuously applied to the discharge lamp 200 during the time period from time t3 to time t4, the high voltage of the ignition voltage Von (3 kV) is applied intermittently to the discharge lamp 200 during the overall time period.

Therefore, an unexpected excessive current can be suppressed from flowing in the discharge lamp 200 and circuit elements that constitute the discharge lamp ignition apparatus 100, and the discharge lamp 200 can be ignited successfully.

Furthermore, because the drive frequency is always higher than the resonant frequency f0 (the range B shown in FIG. 3 and FIG. 4), a surge current which is an unexpected excessive current is not generated in the drain current Id flowing in the inverter circuit unit 120.

In other words, even if the resonant voltage peak voltage Vp at the resonant frequency f0 is 4 kV, if the voltage detection circuit unit 140 detects that the resonant voltage is the ignition voltage Von (3 kV), the frequency f1 (the drive frequency is (f1)/3) at the resonant voltage (=ignition voltage Von) is established as the drive frequency (the discharge-lamp-ignition drive frequency) of the inverter circuit unit 120. Accordingly, a current which is excessive more than necessary can be prevented from flowing, and because the drive frequency is always higher than the resonant frequency f0 (the range B shown in FIG. 3 and FIG. 4), the surge current which is an unexpected excessive current is not generated in the drain current Id flowing in the inverter circuit unit 120.

Furthermore, depending on an individual difference of each circuit element that constitutes the discharge lamp ignition apparatus 100 and environments such as a peripheral temperature, there is a possibility that the resonant voltage of 3 kV cannot be outputted. That is, the voltage detection circuit unit 140 cannot detect the ignition voltage Von (=3 kV). In this case, the drive frequency (the discharge-lamp-ignition drive frequency) of the inverter circuit unit 120 cannot be established, resulting in a possibility of control failure of the inverter circuit unit 120 by the control circuit unit 150.

Specifically, during a process of lowering the drive frequency of the inverter circuit unit 120 gradually from the initial frequency fs at predetermined intervals, the resonant voltage peak voltage Vp is detected before the ignition voltage Von (=3 kV) is detected. At this time, there is a possibility that the discharge lamp 200 is ignited; however, in most cases, applying a high voltage to the discharge lamp 200 just one time cannot cause an insulation breakdown between the electrodes of the discharge lamp 200, resulting in a possibility of ignition failure. In other words, in order to cause an insulation breakdown between the electrodes of the discharge lamp 200, it is required to reduce the possibility of ignition failure significantly by applying a high voltage intermittently between the electrodes of the discharge lamp 200 even if the voltage is lower than the resonant voltage peak voltage Vp.

Figure 6:
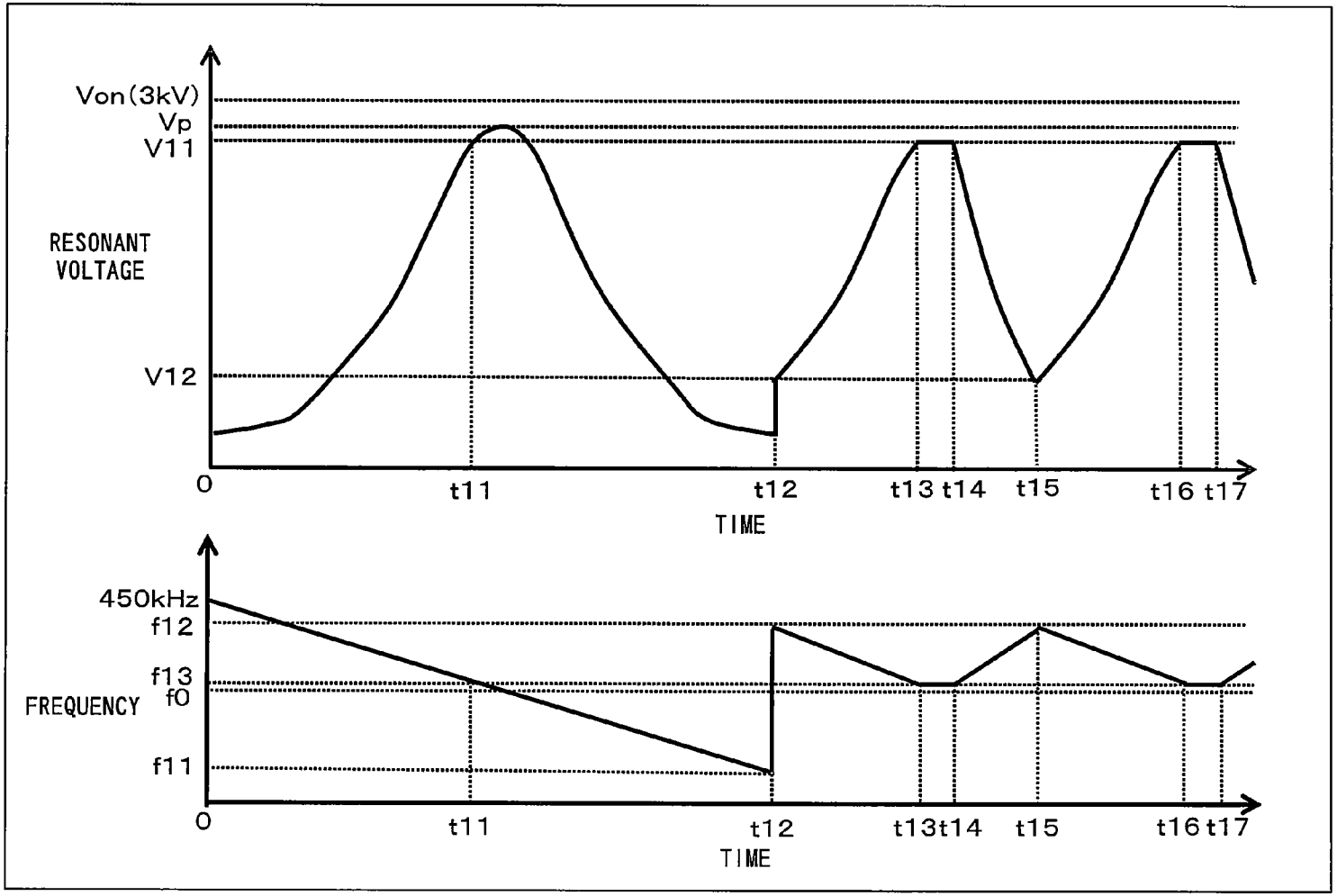
FIG. 6 is a timing chart illustrating the resonant voltage generated by the resonant circuit unit 130 and the drive frequency of the inverter circuit unit 120 in a case where the resonant voltage does not reach the ignition voltage Von.

FIG. 6 is a timing chart illustrating the resonant voltage generated by the resonant circuit unit 130 and the drive frequency of the inverter circuit unit 120 in a case where the resonant voltage does not reach the ignition voltage Von. In the same manner as described referring to FIG. 5, the initial frequency fs is set to a frequency (450 kHz) which is sufficiently higher than the resonant frequency f0 (≈350 kHz) by the resonant circuit unit 130 and the drive of the inverter circuit unit 120 is started (the drive frequency is 150 kHz).

Then, the drive frequency is lowered gradually from the initial frequency fs (=450 kHz) at predetermined intervals; however, at this time, the voltage detection circuit unit 140 does not detect the resonant voltage generated by the resonant circuit unit 130 reaching the ignition voltage Von (3 kV) but detects the resonant voltage peak voltage Vp at the resonant frequency f0.

More specifically, by lowering the drive frequency of the inverter circuit unit 120 gradually from the initial frequency fs at predetermined intervals, the resonant voltage is raised. Then, the drive frequency of the inverter circuit unit 120 is lowered from the resonant frequency f0 further to a frequency (the range A) which is lower than the resonant frequency f0, and even further to a frequency f11 which is sufficiently lower than the resonant frequency f0 at time t12. At this time, during a time period from time 0 to time t12, the voltage detection circuit unit 140 detects the resonant voltage peak voltage Vp at the resonant frequency f0.

It should be noted that, in the time period from time 0 to time t12, a resonant voltage V11 at a frequency f13 (time t11) which is a predetermined value higher than the resonant frequency f0 is established as a high voltage for igniting the discharge lamp 200, and the frequency f13 (the drive frequency is (f13)/3) is determined as the discharge-lamp-ignition drive frequency which is a frequency for igniting the discharge lamp 200.

At time t12, the drive frequency of the inverter circuit unit 120 is raised momentarily to a frequency f12 which is a predetermined value higher than the resonant frequency f13.

During a time period from time t12 to time t13, by lowering the drive frequency of the inverter circuit unit 120 gradually from the frequency f12 to the above described frequency f13 at predetermined intervals, the voltage detection circuit unit 140 detects the resonant voltage generated by the resonant circuit unit 130 reaching the resonant voltage V11.

During a time period from time t13 to time t14, by maintaining the frequency f13 (the drive frequency is ⅓ thereof), the resonant voltage V11 is applied continuously to the discharge lamp 200.

Then, during a time period from time t14 to time t15, the drive frequency is raised to the frequency f12, and the resonant voltage is lowered to a resonant voltage V12 which is sufficiently lower than the resonant voltage V11.

Subsequently, operations from time t12 to time t15 are repeated until the discharge lamp 200 is ignited.

As described above, while the high voltage of the resonant voltage V11 (a voltage slightly lower than the peak voltage) is applied continuously to the discharge lamp 200 during the time period from time t13 to time t14, the high voltage of the resonant voltage V11 is applied intermittently to the discharge lamp 200 during the overall time period.

Therefore, by suppressing an unexpected excessive current/voltage from flowing in/being applied to the discharge lamp 200 and the circuit elements that constitute the discharge lamp ignition apparatus 100 and successfully applying the resonant voltage V11 which is a high voltage to the discharge lamp 200, the discharge lamp 200 can be ignited stably. Furthermore, because the drive frequency is always higher than the resonant frequency f0 (the range B shown in FIG. 3 and FIG. 4), the surge current which is an unexpected excessive current is not generated in the drain current Id flowing in the inverter circuit unit 120.

More specifically, even when the voltage detection circuit unit 140 does not detect the ignition voltage Von (=3 kV), the resonant voltage V11 which is near the peak voltage Vp at around the resonant frequency f0 can be continuously outputted. Consequently, ignition performance of the discharge lamp 200 can be significantly improved when compared to the case where a high voltage is applied only one time.

Furthermore, because the drive frequency is always higher than the resonant frequency f0 (the range B shown in FIG. 3 and FIG. 4), the surge current which is an unexpected excessive current is not generated in the drain current Id flowing in the inverter circuit unit 120.

Figure 7:
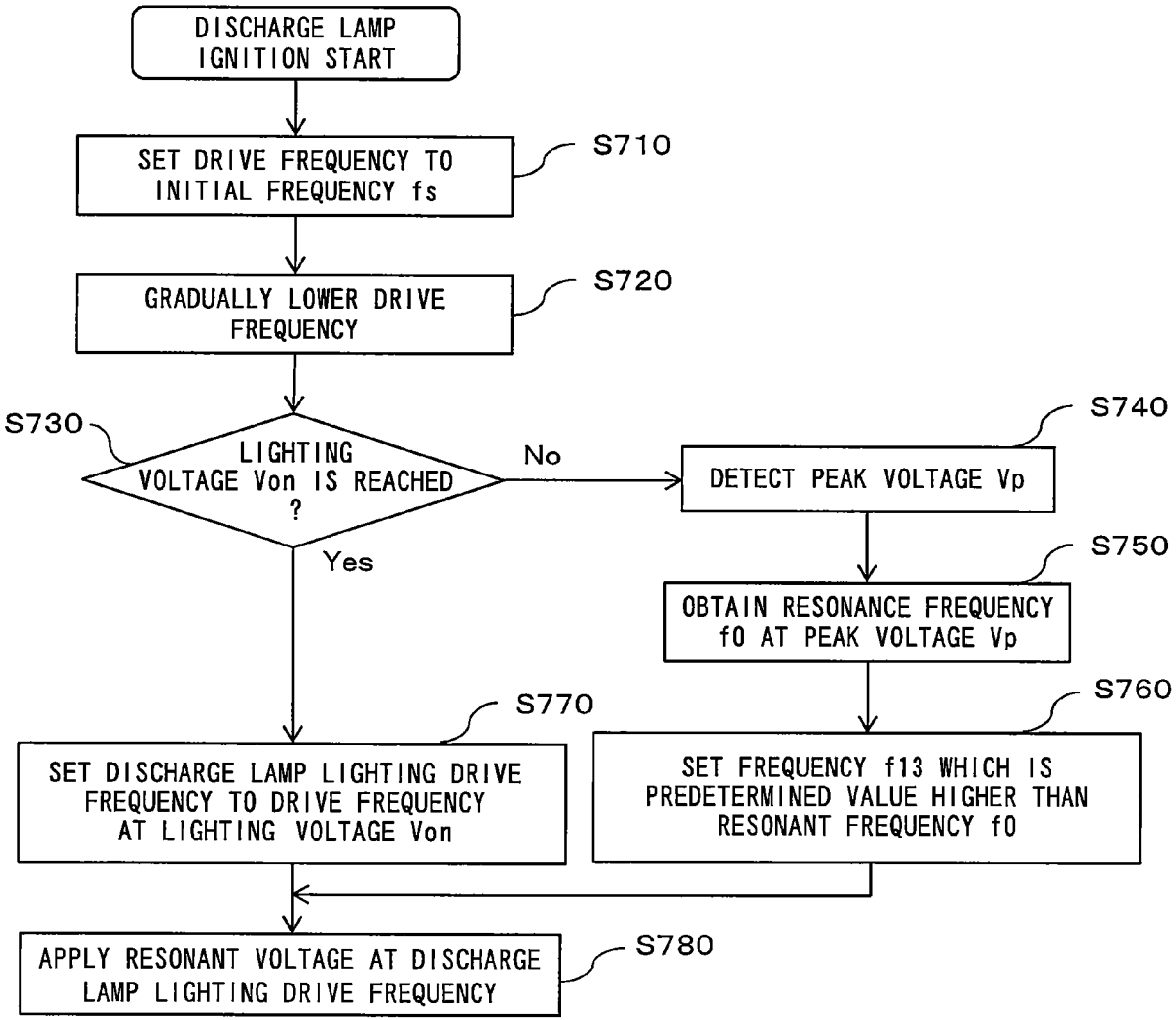
FIG. 7 is a flow chart illustrating a procedure of a discharge lamp ignition method 700 which is performed by the discharge lamp ignition apparatus 100 according to the embodiment of the present invention.

Next, a procedure of a discharge lamp ignition method which is performed by the discharge lamp ignition apparatus 100 according to the embodiment of the present invention will be described in detail. FIG. 7 is a flow chart illustrating a procedure of a discharge lamp ignition method 700 which is performed by the discharge lamp ignition apparatus 100 according to the embodiment of the present invention.

Firstly, when an instruction for starting to ignite a discharge lamp is issued, the control circuit unit 150 sets the drive frequency of the inverter circuit unit 120 to the initial frequency fs in step S710.

In step S720, the control circuit unit 150 lowers the drive frequency of the inverter circuit unit 120 gradually from the initial frequency fs at predetermined intervals.

In step S730, the control circuit unit 150 determines whether the resonant voltage in the resonant circuit unit 130 has reached the ignition voltage Von. Specifically, the voltage detection circuit unit 140 may monitor the resonant voltage in the resonant circuit unit 130, and when the resonant voltage has reached the ignition voltage Von, the voltage detection circuit unit 140 may notify the control circuit unit 150 of the information.

At this time, when the resonant voltage does not reach the ignition voltage Von, the procedure returns to step S740 (No in step S730), while when the resonant voltage has reached the ignition voltage Von, the procedure proceeds to step S770 (Yes in step S730). It should be noted that, when the procedure proceeds to step S770, the peak voltage Vp>the>ignition voltage Von, and the discharge lamp ignition apparatus 100 performs operations as described referring to FIG. 5.

In step S740, the control circuit unit 150 detects the resonant voltage peak voltage Vp in the resonant circuit unit 130. Specifically, the voltage detection circuit unit 140 may monitor the resonant voltage in the resonant circuit unit 130 and detect the resonant voltage peak voltage Vp, and then notify the control circuit unit 150 of the information.

At this time, when the resonant voltage does not reached the ignition voltage Von (No in step S730) and the resonant voltage peak voltage Vp in the resonant circuit unit 130 is detected, the peak voltage Vp≦the ignition voltage Von, and the discharge lamp ignition apparatus 100 performs operations as described referring to FIG. 6.

In step S750, the control circuit unit 150 obtains the resonant frequency f0 at the peak voltage Vp. Specifically, the voltage detection circuit unit 140 may monitor the resonant voltage in the resonant circuit unit 130, and the control circuit unit 150 may, by recognizing that the resonant voltage has reached the peak voltage Vp, obtains the resonant frequency f0 at the peak voltage Vp.

In step S760, the control circuit unit 150 sets the discharge-lamp-ignition drive frequency to the frequency f13 which is a predetermined value higher than the resonant frequency f0.

In step S770, the control circuit unit 150 sets the discharge-lamp-ignition drive frequency to the drive frequency at the ignition voltage Von.

In step S780, the control circuit unit 150 performs a control operation so as to drive the inverter circuit unit 120 at the discharge-lamp-ignition drive frequency which is set in step S760 or step S770. Accordingly, the high voltage of the resonant voltage V11 or the ignition voltage Von is applied to the discharge lamp 200.

As described above, in the discharge lamp ignition apparatus 100 and the discharge lamp ignition method 700 according to the embodiment of the present invention, when igniting the discharge lamp 200, by controlling a high voltage applied to the discharge lamp 200, the discharge lamp 200 can be ignited successfully and an unexpected excessive current/voltage can be suppressed from flowing in/being applied to the discharge lamp 200 and the circuit elements that constitute the discharge lamp ignition apparatus 100.

While the invention has been described in detail, the foregoing description is in all aspects illustrative and not restrictive. It will be understood that numerous other modifications and variations can be devised without departing from the scope of the invention.

What is claimed is:

1. A discharge lamp ignition apparatus for igniting a discharge lamp, the discharge lamp ignition apparatus comprising:

a direct-current power supply generation circuit unit for supplying a direct-current power supply voltage;

a resonant circuit unit constituted from an inductor and a capacitor, for applying a resonant voltage generated by the inductor and the capacitor to the discharge lamp;

a voltage detection circuit unit for detecting the resonant voltage being applied to the discharge lamp;

an inverter circuit unit for, based on the direct-current power supply voltage supplied by the direct-current power supply generation circuit unit, alternating-current driving the resonant circuit unit at a drive frequency; and a control circuit unit for monitoring the resonant voltage detected by the voltage detection circuit unit and controlling the inverter circuit unit based on the resonant voltage, wherein the control circuit unit:

lowers the drive frequency from a predetermined initial frequency and when the resonant voltage reaches an ignition voltage at which the discharge lamp ignites, establishes the drive frequency for the ignition voltage as a discharge-lamp-ignition drive frequency being the frequency for igniting the discharge lamp; and if the resonant voltage does not reach the ignition voltage even though the drive frequency is lowered from the predetermined initial frequency to the resonant frequency, establishes as the discharge-lamp-ignition drive frequency a frequency that is a predetermined value higher than the drive frequency at the resonant-voltage peak voltage; and the inverter circuit unit alternating-current drives the resonant circuit unit at the discharge-lamp-ignition drive frequency established by the control circuit unit.

2. The discharge lamp ignition apparatus according to claim 1, wherein the control circuit unit controls the inverter circuit unit at the discharge-lamp-ignition drive frequency.

3. The discharge lamp ignition apparatus according to claim 2, wherein the control circuit unit establishes the discharge-lamp-ignition drive frequency continuously for a predetermined time period.

4. The discharge lamp ignition apparatus according to claim 2, wherein the control circuit unit periodically establishes the discharge-lamp-ignition drive frequency.

5. A discharge lamp ignition method performed by a discharge lamp ignition apparatus for igniting a discharge lamp, the method comprising the steps of:

setting a drive frequency at which an inverter circuit is driven to a predetermined initial frequency;

lowering the drive frequency gradually from the initial frequency at predetermined intervals;

detecting whether a resonant voltage in a resonant circuit constituted from an inductor and a capacitor has reached a preset ignition voltage for igniting the discharge lamp;

obtaining, if the resonant voltage does not reach the ignition voltage, a drive frequency at a resonant-voltage peak voltage that is lower than the ignition voltage and establishing, as a discharge-lamp-ignition drive frequency, the drive frequency a predetermined value higher than the resonant frequency;

obtaining the drive frequency at the ignition voltage if the resonant voltage reaches the ignition voltage;

setting the drive frequency as the discharge-lamp-ignition drive frequency; and performing a control operation so as to drive the inverter circuit at the discharge-lamp-ignition drive frequency.

* * * * *